US005255496A

United States Patent [19]

Gregoire

[11] Patent Number: 5,255,496

[45] Date of Patent: Oct. 26, 1993

[54] DEVICE FOR TRANSFERRING OBJECTS AGAINST THE CURRENT OF A GAS STREAM

[75] Inventor: Jean F. Gregoire, Roux Mesnil Bouteilles, France

[73] Assignee: Kerplas S.N.C., Dieppe Cedex, France

[21] Appl. No.: 829,053

[22] PCT Filed: Jun. 12, 1991

[86] PCT No.: PCT/FR91/00471

§ 371 Date: Feb. 7, 1992

§ 102(e) Date: Feb. 7, 1992

[87] PCT Pub. No.: WO91/19646

PCT Pub. Date: Dec. 26, 1991

[30] Foreign Application Priority Data

Jun. 13, 1990 [FR] France ..... 90 07363

[51] Int. Cl.[5] ..... B65B 31/02; B65B 9/20

[52] U.S. Cl. ..... 53/511; 53/551

[58] Field of Search ..... 53/433, 451, 511, 551, 53/552, 550

[56] References Cited

U.S. PATENT DOCUMENTS

| | | | |
|---|---|---|---|
| 3,040,490 | 6/1962 | Virta | 53/551 X |
| 3,482,373 | 12/1969 | Morris | 53/511 |
| 3,681,892 | 8/1972 | Safranski | 53/551 |
| 4,522,581 | 6/1985 | Schad et al. . | |
| 4,606,174 | 8/1986 | Berg | 53/551 X |
| 5,044,140 | 9/1991 | Iwano et al. | 53/551 X |
| 5,074,104 | 12/1991 | Desjonqueres et al. | 53/551 X |

FOREIGN PATENT DOCUMENTS 0206096 12/1986 European Pat. Off. .

*Primary Examiner*—Horace M. Culver

*Attorney, Agent, or Firm*—Wenderoth, Lind & Ponack

[57] ABSTRACT

A device for transferring objects from one atmosphere into a second atmosphere includes a housing which encloses an area through which the objects travel between an inlet funnel and an outlet in the housing. The objects are set in motion in a specified direction of travel. A gas stream is caused to circulate inside the housing in a direction of travel opposite to that of the objects.

22 Claims, 4 Drawing Sheets

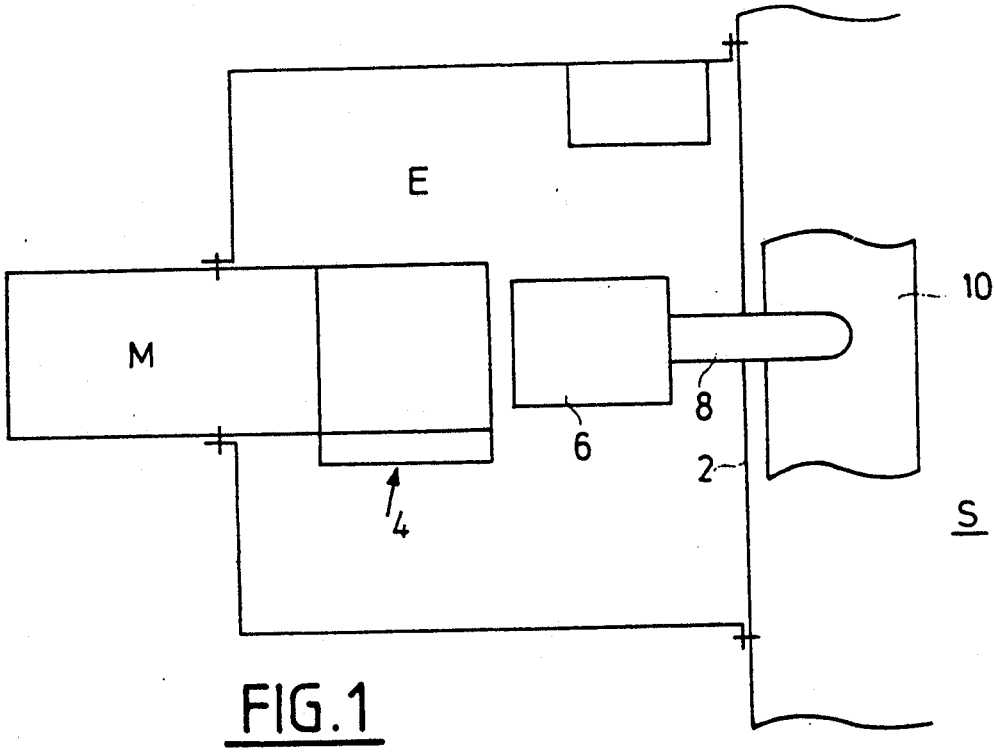
FIG. 1
FIG. 2.
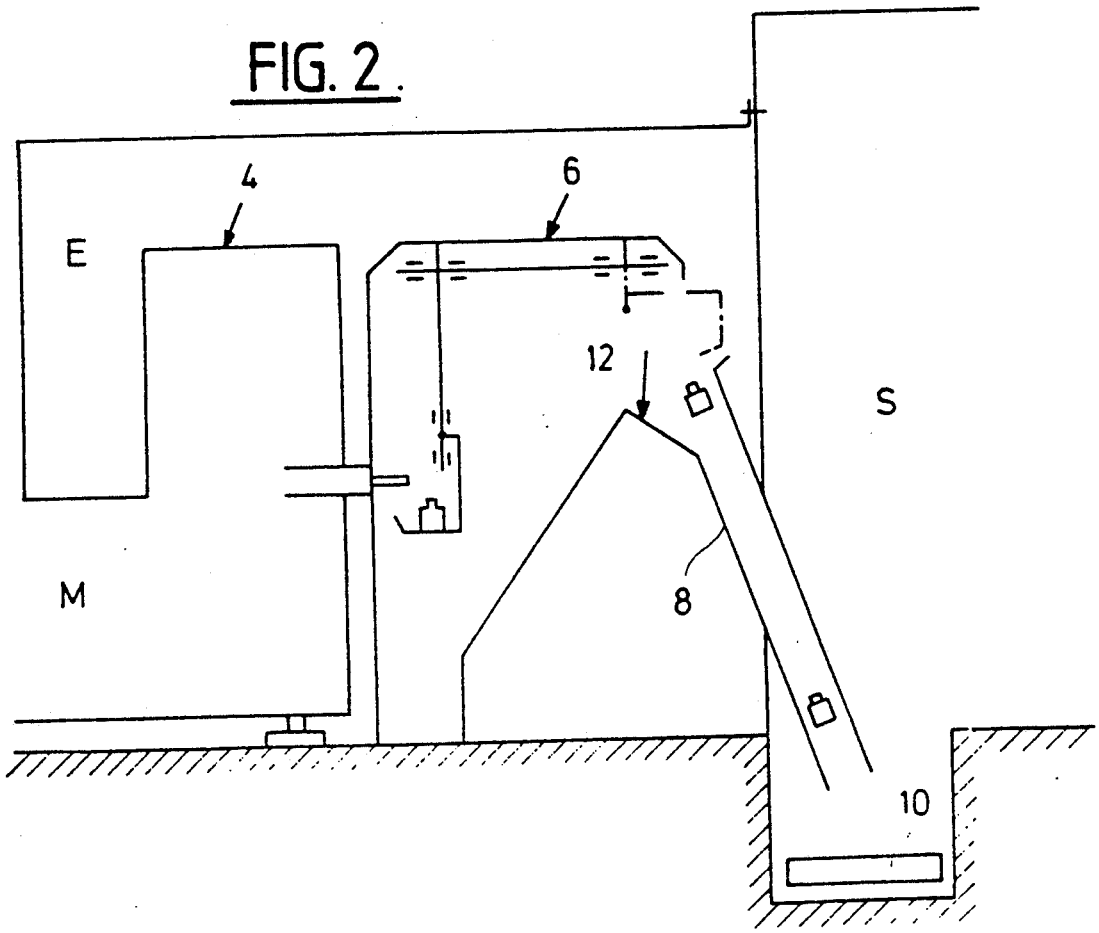

DEVICE FOR TRANSFERRING OBJECTS AGAINST THE CURRENT OF A GAS STREAM

BACKGROUND OF THE INVENTION

The present invention relates to a device for transferring objects in gaseous atmospheres with a controlled content of impurities, particularly plastic bottles intended for the pharmaceutical industry.

As a matter of fact, for packaging medicines and other pharmaceutical products, bottles are used which contain air with a very low percentage of impurities. In other words, the air contained in bottles designed for the pharmaceutical industry should have a specific level of particulate purity.

The same thing applies to the production and packaging of surgical materials, or components designed for the electronics industry, for example.

The particulate purity of the air or of a gas is defined and classified by the French standard NF-X 44-101.

Under such standard, the dust content of a gas is defined by the numerical concentration of floating particles, the sizes of which exceed specified granulometric levels (generally speaking 5 microns and 0.5 microns). The limit for each class of dust content is established by specifying a maximum numerical concentration for each of the particle size classes.

The NF-X 44-101 standard provides a simplified procedure, defining three classes in accordance with the table below:

| Class of dust content | Maximum concentration in number of particles per cubic meter for each level | |
|---|---|---|
| | 0.5μ | 5μ |
| 4,000,000 | 4,000,000 | 25,000 |
| 400,000 | 400,000 | 2,500 |
| 4,000 | 4,000 | 25 |

In the following text, classes defined by means of this simplified procedure are used to categorize the particulate purity of the air in various parts of the invention to explain a preferred way in which to implement the invention.

The pharmaceutical industry stipulates that manufacturers must supply bottles containing air which is as pure as possible, corresponding at most to class 400,000.

With this in mind, manufacturers install their production machinery in a sealed enclosure which is continuously swept out by a laminar stream of class 400,000 air.

The manufactured bottles are manually placed in a plastic bag by a technician who enters the enclosure through an airlock, closes the bag and carries the bags out of the sealed enclosure through the airlock. The technician must take great care regarding his personal hygiene and clothing: gloves, white smock or one-piece garment with all particles removed, i.e. free of any particles which could adhere to them; overshoes, headgear, mask etc.

Despite all these precautions, which represent a considerable investment in themselves, such a procedure represents a not inconsiderable risk of accidental pollution of the bottles. Manufacturers can guarantee that their bottles have been produced in conditions which meet the specified standards of purity, but cannot guarantee the result.

SUMMARY OF THE INVENTION

To rectify these inconveniences, the aim of this invention is to enable manufacturers to produce objects of a guaranteed level of purity by eliminating human intervention.

Bearing this aim in mind, the object of the invention is to provide a device for transferring objects from one atmosphere into a second atmosphere, the device including a housing, which encloses the area through which the objects travel from an inlet funnel to an outlet in the housing, various means for setting the objects in motion in a specified direction of travel, and devices for circulating a gas stream inside the housing in a direction of travel opposite to that of the objects.

With respect to other characteristics:

the housing is a tube having an open upper end which forms the inlet funnel, an open lower end forming the outlet and opening into a movable receptacle with solid sides, the objects being set in motion by gravity, and the wall of the tube includes an opening through which the gas stream enters the tube.

The devices for causing the gas stream to circulate include an inlet pipe for the gas stream which opens into the opening in the tube, a device for directing the flow being located in the tube and designed to direct the flow in the form of a cylindrical annular stream flowing along the internal wall of the tube in the direction in which the objects are travelling, then along the sidewalls of the receptacle, the bottom of the receptacle then reflecting back the annular stream as a central stream running coaxially along the tube up to the inlet tunnel of the tube, in a direction opposite to that in which the objects are travelling.

The tube is cylindrical and the directing device is a sleeve tube located opposite the tube opening, the surface of the sleeve tube being positioned near the inner surface of the tube and, with the latter, enclosing a ring-shaped space sealed at an upper axial end thereof by a flange cast integrally with the sleeve tube and fixed to that part of the inner surface of the tube situated between the tube opening and the inlet funnel.

The movable receptacle is a bag made out of plastic, the neck of which encloses the lower end of the tube.

The invention also concerns a plant for producing and packaging objects such as plastic bottles and including an enclosure which constitutes a first atmosphere in which at least a final production stage of the bottles or other objects takes place, and a chamber isolated from the enclosure and constituting a second atmosphere in which at least a first stage of packaging the bottles takes place, and including at least one transferring device for transporting objects from the enclosure to the chamber.

The plant also includes a bag feed attachment including a reel supplying plastic film, the latter enclosing the lower end of the tube in such a way that its edges overlap a portion along a generatrix of the tube, a first heat fusing device located opposite such generator and designed to shape the film into a cylinder around the same axis as the tube, and a second heat fusing device positioned below the tube outlet and designed to close the bottom of the bag.

The plant includes a device for counting the number of bottles entering a bag, a third heat fusing device located axially beyond the second heat fusing device and, designed to seal the bag hermetically once it contains a predetermined number of bottles, and a device for separating the sealed bag from the coaxial cylinder described above.

BRIEF DESCRIPTION OF THE DRAWINGS

The features of the invention are discussed in detail in the following detailed description, with reference to the accompanying drawings in which:

FIG. 1 is a schematic top view of a plant including a transfer device according to invention;

FIG. 2 is a schematic side view of the plant shown in FIG. 1;

DETAILED DESCRIPTION OF THE INVENTION

Figure 3:
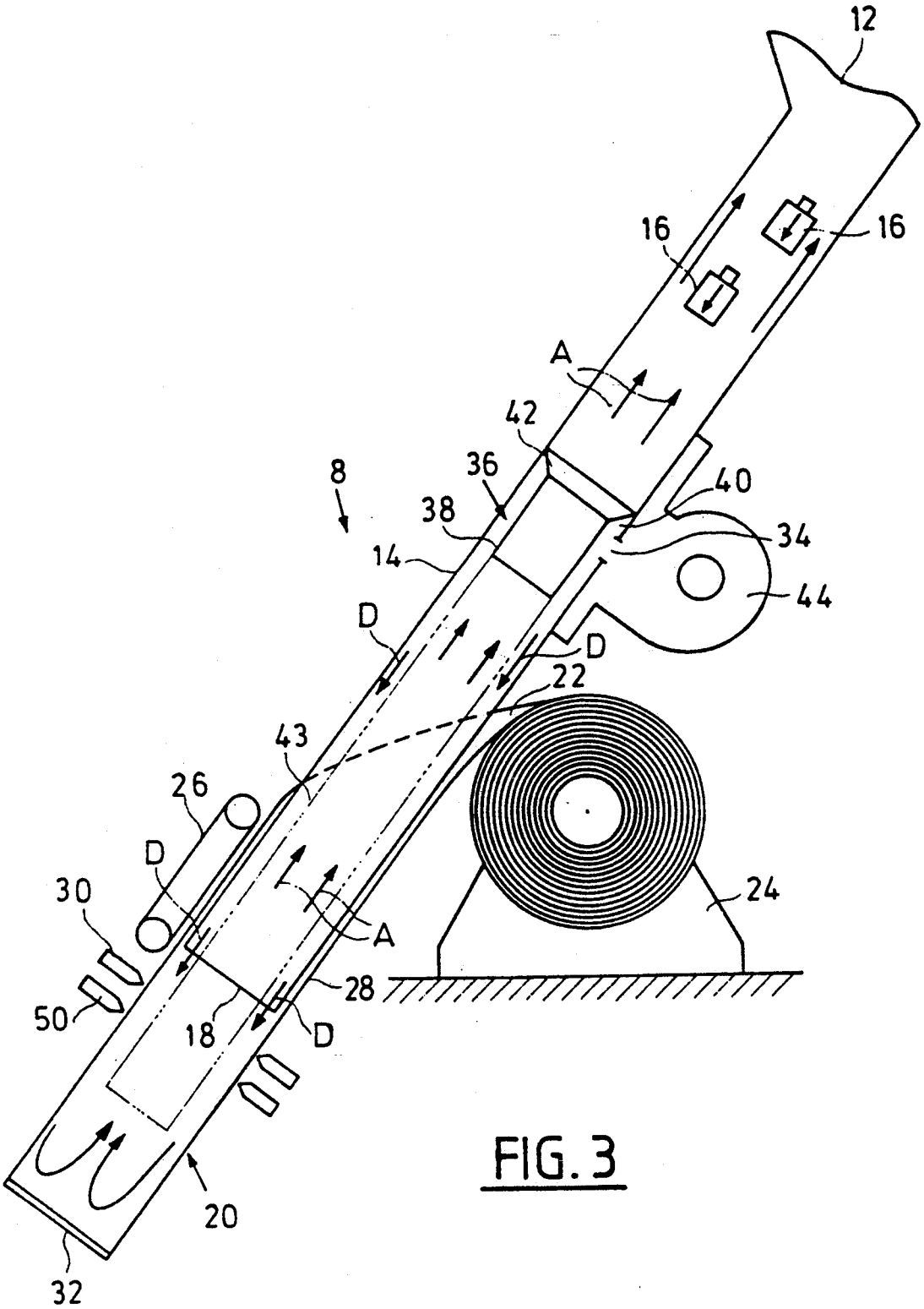
FIG. 3 is a schematic view of a transfer device according to invention.

FIG. 1 includes a diagrammatic representation of an enclosure E, constituting a first atmosphere. The enclosure E is separated by a bulkhead 2 from a chamber S which comprises a second atmosphere.

The enclosure E contains part of one end 4 of a machine M designed to produce bottles made out of plastics.

The end 4 of the machine includes at least the point from which the bottles manufactured by the machine M are ejected.

The bottles are transported by a materials handling device 6 to a transfer device 8 according to invention.

The transfer device 8 passes through an airtight seal in the wall 2 and opens into the chamber S above a conveyor belt 10.

The first atmosphere is a class 400,000 environment, and the second atmosphere corresponds to a class 4,000 atmosphere.

FIG. 2 includes a diagrammatic representation of the materials handling device 6 which is designed to recover the bottles from the extraction point on the machine M and then transport them to a point just above an inlet funnel 12 of the transfer device 8.

It should be noted that between the extraction point and the inlet funnel 12, a sorting device, known in the art and not illustrated here, can be installed in order to prevent defective bottles from entering the transfer device 8.

FIG. 3 illustrates the transfer device 8 according to invention.

The transfer device 8 consists of a tube 14 with an interior diameter which is greater than that of the bottles 16 which are to be transferred.

The axis of the tube 14 is inclined at an angle to the vertical.

The tube 14 has an open upper end in the shape of funnel, which forms the inlet funnel 12 and facilitates the introduction into the tube 14 of the bottles 16 falling from the transfer device 6.

The bottles 16 are set in motion by gravity, the tube serving to guide them as they travel along.

The tube 14 has an open lower end which forms an outlet 18.

The lower end of the tube 14 opens into a bag 20 made out of plastic material, the mouth of which tightly encloses the lower end of the tube.

The bag 20 is formed from a plastic film 22 rolled on a drum 24.

The film 20 encloses the lower part of the tube 14 in such a way that two longitudinal edges of film 20 overlap along a generatrix of the tube facing a heat fusing device 26, which is thus able to form a joint and shape the sheet 20 into a cylinder 28 surrounding the lower end of the tube 14.

After making the joint, the heat fusing device 26 causes the cylinder 28 to slide along the tube 14 up to and beyond the outlet 18.

A heated radial clamp 30 positioned below the outlet 18 is designed to shape the bottom 32 of the bag. The heat-sealed bottom 32 is airtight.

The tube 14 includes a lateral opening 34 in its tubular sidewall.

An orienting device 36 is positioned inside the tube 14. The device 36 consists of a member in the form of a tubular sleeve or sleeve tube 38 which is coaxial with the tube 14, the surface of the sleeve tube facing the opening 34.

The sleeve tube 38 has an external diameter which is smaller than the internal diameter of the tube 14, so that a ring-shaped space 40 is created between them. The opening 34 opens into this ring-shaped space 40.

The open end of sleeve tube 38 which is disposed between opening 34 and inlet funnel 12 comprises an annular flange 42 which is fixed on the internal face of tube 14, closing the upper end of ring-shaped space 40.

A device 44 known in the art is designed to blow class 4,000 air through the opening 34.

A stream of ionized class 4,000 air is directed by the orienting device 36 in an annular stream which flows downwards along the inner surface of the tube 14, then along the cylindrical sidewall of the bag 20.

This stream of ionized air will mean that it is possible to avoid introducing particles, prevent the creation of electrostatic areas on the surface of the bottles and to sweep away any particles which may be positioned on the sides of the bottles originating in the enclosure E.

The imaginary flow of the annular stream is indicated in FIG. 3 by dot-and-dash lines 43, the direction of the flow being represented by arrows D. The dot-and-dash lines 43 are represented as an extension of the wall of the sleeve tube 38.

It should be noted that the wall of the sleeve tube may extend further, for example right up to the outlet 18 and even beyond.

The annular stream strikes the bottom 32 of the bag 20, which reflects it back and transforms it into a central stream running coaxially up the tube, as shown schematically by the arrows A, that is, in the opposite direction to the annular stream and surrounded by the latter.

The rising stream flows along the axis of the bag 20, passes through the inner space of the sleeve tube 36 and then flows into the section of the tube 14 situated above the flange 42, right up to the inlet funnel 12, through which it emerges from the transfer device 8.

The bottles 16 travel between the inlet funnel 12 and the bag 20 against the direction of flow of the rising coaxial stream, any impurities which may be adhering to the external surfaces of the bottles 16 being carried off by this same rising stream.

So that the bottles entering into the transfer device 8 should be sufficiently clean, thus facilitating the action of the ascending axial stream, the enclosure E includes a device known in the art which fills the enclosure with class 400,000 air by means of filtered laminar streams.

As a variation on this, the enclosure may be open to the ordinary atmosphere and the materials handling device 6 may be covered by an airtight fairing and supplied by laminar streams of class 400,000 air.

As a matter of fact, on emerging from the mold, each bottle is clean but is contaminated by contact with the air surrounding the mold-breaking and ejection area. The fact that this air is class 400,000 (ambient atmosphere in the enclosure or in the materials handling device) limits the extent to which the bottle is contaminated and makes it easier to eliminate impurities in the transfer device according to invention.

In order to avoid subsequent pollution of the bottles, the design provides for a second radial heat fusing device 50 situated axially beyond the radial heat fusing device 30, beyond the outlet 18 of the tube 14.

Figure 4:
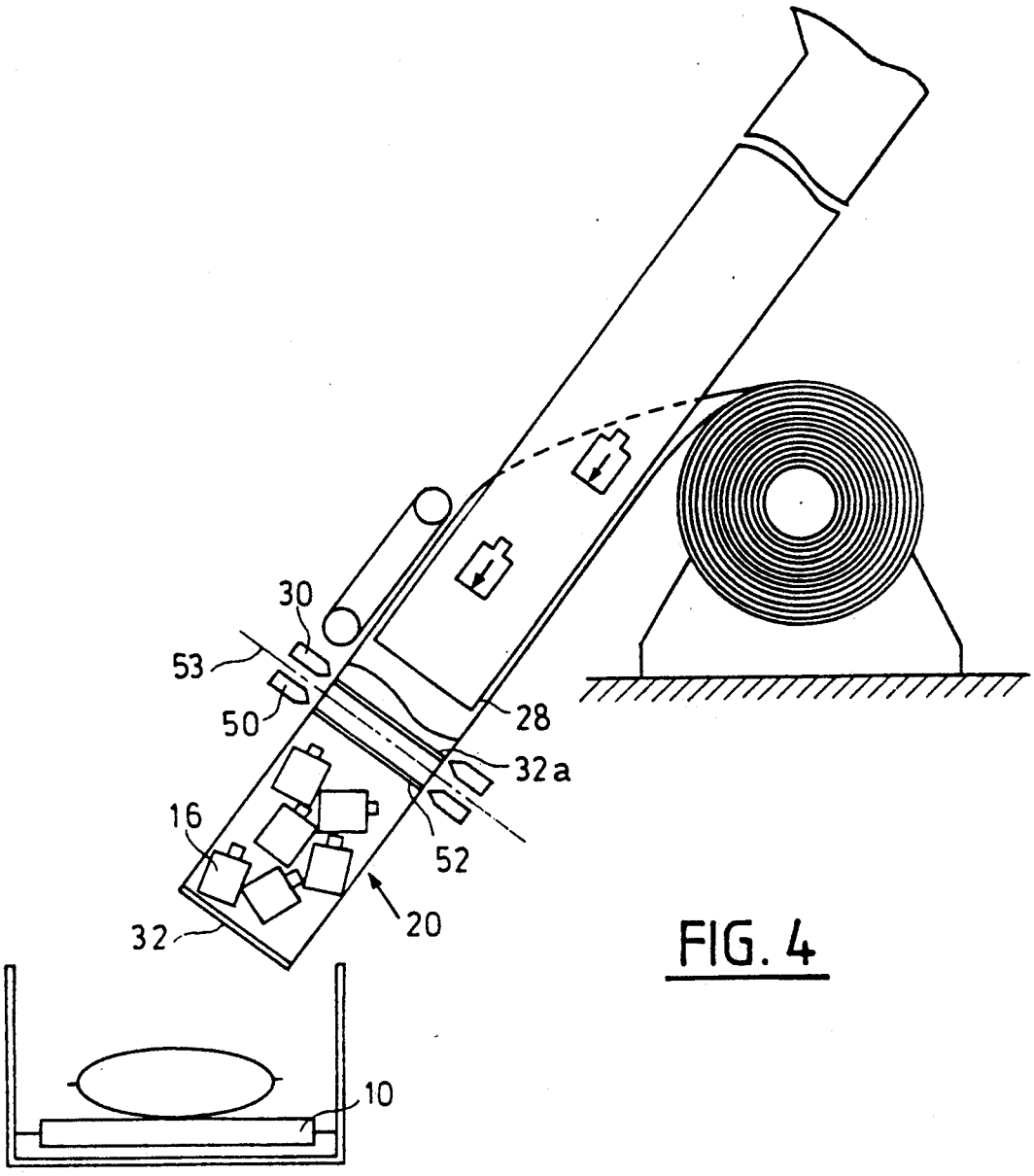
FIG. 4 is a schematic view of a device for shaping bags and a device for removing the latter.

A cutting device 53, known in the art and represented schematically by a dot-and-dash line in FIG. 4, is located between the two radial heat fusing devices.

A device for counting the bottles, known in the art and not illustrated, issues a command to the heat fusing device 50 when the bag 20 contains a predetermined number of bottles (see FIG. 4), which then seals the bag 20 at a welded joint 52 so that the bag is airtight, while the heat fusing device 30 simultaneously creates the bottom 32*a* of the following bag.

Once these two joints or welds have been made, the cutting device 53 detaches the bag 20, which falls onto the conveyor belt 10.

Figure 5:
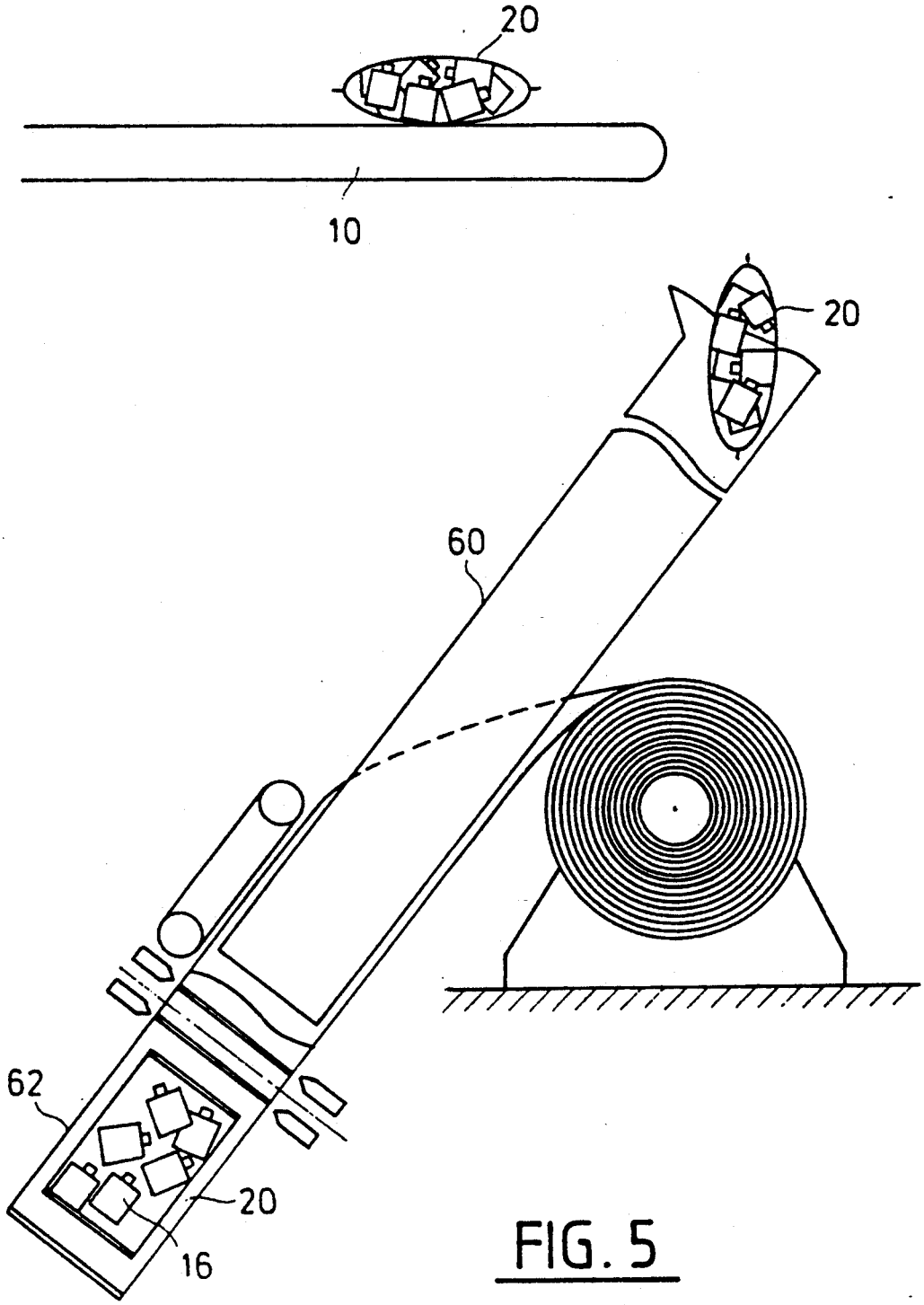
FIG. 5 is a view of a device for bagging the bags, implemented in conformity with the device for shaping the bags illustrated in FIG. 4.

The conveyor belt 10 carries the bag over a bagging device situated in the chamber S, that is to say, in a class 4,000 ambient atmosphere (see FIG. 5).

The bagging device includes a cylindrical tube 60, into which the bags 20 fall.

The lower end of the tube 60 is equipped with a bagging device similar to that described with reference to FIG. 4.

In this way the bag 20 containing the predetermined number of bottles 16 is wrapped up in a second bag 62, in which the ambient atmosphere is categorized as class 4,000.

This double protection provides extra security with regard to the handling and transport of bottles which have been packaged in this way.

The transfer device 8 described above, which receives bottles subjected to a class 400,000 atmosphere and transfers them into a class 4,000 atmosphere, means that it is possible to guarantee a level of purity of class 400,000, which is a considerable improvement on those bottles for which only the production process can be guaranteed.

I claim:

1. A plant including an enclosure defining a first atmosphere, a chamber isolated from said enclosure and defining a second atmosphere, and at least one transfer device for transferring objects from said enclosure to said chamber, said transfer device comprising:

a tube extending from said enclosure to said chamber and having an open upper end to receive objects from said enclosure and an open lower end opening into a movable receptacle having solid walls and located in said chamber, said tube defining a space through which objects move by gravity in a defined direction of travel from said enclosure to said receptacle in said chamber, and said tube having in a sidewall thereof an opening into said space; and a gas directing arrangement for directing gas through said opening into said tube and for causing a stream of said gas to flow within said tube in a direction opposite to said direction of travel of the objects.

2. A plant as claimed in claim 1, wherein said open upper end of said tube is in the shape of an inlet funnel.

3. A plant as claimed in claim 1, wherein said tube is oriented in a manner inclined to the vertical.

4. A plant as claimed in claim 1, wherein said gas directing arrangement includes a member positioned within said tube for directing gas entering said tube through said opening to flow as an annular cylindrical stream along an internal surface of said tube and then along an inner surface of said receptacle in said direction of travel of the objects to a bottom of said receptacle, whereby said bottom of said receptacle reflects said annular cylindrical stream to form a central stream flowing coaxially along said tube in said opposite direction.

5. A plant as claimed in claim 4, wherein said tube is cylindrical.

6. A plant as claimed in claim 4, wherein said member comprises a tubular sleeve positioned within said tube opposite said opening, said sleeve having an outer surface spaced inwardly of said internal surface of said tube and defining therewith an annular space having a closed upper axial end and an open lower axial end.

7. A plant as claimed in claim 4, wherein said upper axial end of said annular space is closed by an upper end of said sleeve at a position between said opening and said upper end of said tube.

8. A plant as claimed in claim 7, wherein said upper end of said sleeve comprises an integral flange fixed to said internal surface of said tube.

9. A plant as claimed in claim 4, wherein said receptacle comprises a bag formed of plastic material and enclosing said lower end of said tube.

10. A plant as claimed in claim 9, further comprising a plastic film supply for supplying said plastic material in the form of a film to said lower end of said tube such that opposite edges of said film overlap along a generatrix of said tube, a first heat fusing device positioned to fuse said overlapped edges and thus to form said film into a cylinder located coaxially around said lower end of said tube, and a second heat fusing device positioned below said lower end of said tube for fusing said cylinder to form a bottom of said bag.

11. A plant as claimed in claim 10, further comprising a third heat fusing device located axially below said second heat fusing device for, when a predetermined number of objects have been supplied through said tube into said bag, fusing said bag to form a hermetically sealed top thereof, and a cutting device for removing the thus filled bag from said cylinder of film.

12. A plant as claimed in claim 1, wherein the objects are plastic bottles, and said enclosure has therein at least part of a machine for manufacturing the plastic bottles.

13. A transfer device for transferring objects from a first atmosphere defined by an enclosure to a second atmosphere defined by a chamber isolated from the enclosure, said transfer device comprising:

a tube to be positioned to extend from the enclosure to the chamber and having an open upper end to receive objects from the enclosure and an open lower end to open into a movable receptacle having solid walls and to be located in the chamber, said tube defining a space through which objects move by gravity in a defined direction of travel from the enclosure to the receptacle in the chamber, and said tube having in a sidewall thereof an opening into said space; and a gas directing arrangement for directing gas through said opening into said tube and for causing a stream of said gas to flow within said tube in a direction opposite to said direction of travel of the objects.

14. A device as claimed in claim 13, wherein said open upper end of said tube is in the shape of an inlet funnel.

15. A device as claimed in claim 13, wherein said tube is oriented in a manner inclined to the vertical.

16. A device as claimed in claim 13, wherein said gas directing arrangement includes a member positioned within said tube for directing gas entering said tube through said opening to flow as an annular cylindrical stream along an internal surface of said tube and then along an inner surface of the receptacle in said direction of travel of the objects to a bottom of the receptacle, whereby the bottom of the receptacle reflects said annular cylindrical stream to form a central stream flowing coaxially along said tube in said opposite direction.

17. A device as claimed in claim 16, wherein said tube is cylindrical.

18. A device as claimed in claim 16, wherein said member comprises a tubular sleeve positioned within said tube opposite said opening, said sleeve having an outer surface spaced inwardly of said internal surface of said tube and defining therewith an annular space having a closed upper axial end and an open lower axial end.

19. A device as claimed in claim 18, wherein said upper axial end of said annular space is closed by an upper end of said sleeve at a position between said opening and said upper end of said tube.

20. A device as claimed in claim 19, wherein said upper end of said sleeve comprises an integral flange fixed to said internal surface of said tube.

21. A device as claimed in claim 16, further comprising a plastic film supply for supplying plastic material in the form of a film to said lower end of said tube such that opposite edges of said film overlap along a generatrix of said tube, a first heat fusing device positioned to fuse said overlapped edges and thus to form said film into a cylindrical bag forming the enclosure and located coaxially around said lower end of said tube, and a second heat fusing device positioned below said lower end of said tube for fusing said cylindrical bag to form a bottom of a bag.

22. A device as claimed in claim 21, further comprising a third heat fusing device located axially below said second heat fusing device for, when a predetermined number of objects have been supplied through said tube into said bag, fusing said bag to form a hermetically sealed top thereof, and a cutting device for removing the thus filled bag from said cylinder of film.

* * * * *